US005865555A

United States Patent [19]

Dawson

[11] Patent Number: 5,865,555

[45] Date of Patent: Feb. 2, 1999

[54] CAULKING GUIDE

[76] Inventor: Gerald O. Dawson, 839 Sherrill St., Liberty, Mo. 64068

[21] Appl. No.: 12,687

[22] Filed: Jan. 23, 1998

[51] Int. Cl.[6] ..... B05C 11/00

[52] U.S. Cl. ..... 401/266; 401/261; 222/567; 222/575; 222/23

[58] Field of Search ..... 401/266, 139, 401/265, 261; 222/567, 574, 575, 23, 566; 425/87

[56] References Cited

U.S. PATENT DOCUMENTS

| | | | |
|---|---|---|---|
| 2,903,739 | 9/1959 | Hann | 425/87 |
| 2,988,775 | 6/1961 | Painter et al. | 401/266 |
| 4,981,629 | 1/1991 | Cook | 401/266 |
| 5,033,951 | 7/1991 | Cook . | |
| 5,075,916 | 12/1991 | Englehart . | |
| 5,346,380 | 9/1994 | Ables . | |
| 5,413,258 | 5/1995 | Kartler . | |
| 5,437,074 | 8/1995 | White et al. . | |
| 5,622,728 | 4/1997 | Kartler . | |
| 5,775,551 | 7/1998 | Tordsen | 401/266 |

*Primary Examiner*—David J. Walczak
*Attorney, Agent, or Firm*—Kenneth L. Tolar

[57] ABSTRACT

A caulking guide for allowing a user to easily apply a smooth, straight bead of caulk having a predetermined width. The device includes a flat, bendable but rigid substantially T-shaped plate. The plate includes an elongated portion and a substantially rectangular leg perpendicular thereto and integral therewith. The elongated portion has one or more retaining bands thereon for receiving and surrounding a caulking tube dispensing nozzle. Along a longitudinal outer edge of the applicator tip are a plurality of measurement indicia to allow a user to select a dispensing opening having a desired width. Opposing side edges of the applicator tip may be folded to a substantially vertical position with the fold lines formed at the measurement indicia corresponding to the dimension desired for the dispensing opening. Accordingly, the substantially rectangluar shaped opening formed by folding the device allows a user to apply a smooth and straight joint having a preselected width.

8 Claims, 2 Drawing Sheets

CAULKING GUIDE

BACKGROUND OF THE INVENTION

The present invention relates to a caulking guide and more specifically to a bendable device that may be attached to a caulking tube dispensing nozzle assisting a user in applying a straight, smooth caulk bead having a select width.

DESCRIPTION OF THE PRIOR ART

Caulk is generally used to provide a water tight or air tight seal between adjacent structural members such as windows, shower stall door frames and similar joints. The caulk is usually stored within an elongated, cylindrical container having an end cap at one end and a dispensing nozzle at an opposing end thereof. The caulk container is placed within a caulking gun assembly having a trigger actuated plate that displaces the end cap to force caulk through the dispensing nozzle.

When applying the caulk, a user places the dispensing nozzle immediately adjacent the joint to be sealed and slides the tip along the crevice as the trigger is being depressed. In order to form a caulk joint that is straight and uniform, the user must squeeze the trigger with a consistent force relative to the speed with which the tip is being slid. Regardless, the person applying the caulk often must smooth the caulk bead using a putty knife, a finger or a similar tool.

Numerous devices have been heretofore designed for assisting a user in forming a smooth caulk joint. For example, U.S. Pat. No. 5,413,258 issued to Kartler relates to a caulk wiping device mountable on a caulking gun or tube. The device comprises a wiping arm which is mounted a predetermined distance from the caulking tube nozzle such that, as caulk is applied, the wiping arm subsequently wipes and smooths the caulking bead.

U.S. Pat. No. 5,346,380 issued to Ables relates to a caulking tube extension nozzle for facilitating the distribution of caulk into awkward positions. The extension tube may be bent at various angles while allowing caulk to be dispensed therethrough. The device also includes a spoon member for smoothing a bead of caulk.

U.S. Pat. No. 5,033,951 issued to Cook relates to a caulking applicator and striking tool for smoothing a caulked joint. The device comprises an elongated tube having a tapered end through which caulk is dispensed and which may be subsequently used to smooth the caulk.

U.S. Pat. No. 5,437,074 issued to White et al relates to a caulking tool comprising a rectangular flat plate having a curved tip and a right angular tip extending from an end thereof. The device is used for removing caulk from a sealed joint.

U.S. Pat. No. 5,075,916 issued to Englehart relates to a caulk smoothing device comprising a flat rectangular element having four straight exterior edges and four comers of a predetermined configuration therebetween whereby caulk joints can be formed by moving the tool along the length thereof.

U.S. Pat. No. 5,622,728 issued to Kartler relates to improvements to the device disclosed in Kartler, supra. The improvements include varying pads which may be attached to an end of the wiping arm and the materials and process by which the device is formed.

Although numerous caulk smoothing devices exist in the prior art, none of these devices have the unique features and advantages of the present invention. None of the conventional caulking tools allow a user to create a caulk joint having a desired width. Furthermore, none of the above described devices provide a caulking tube nozzle attachment that allows a user to apply caulk having substantially linear parallel sides thereby forming a caulk joint that is smooth and straight. The present invention provides a nozzle attachment that is inexpensive to manufacture and therefore may be discarded after use.

SUMMARY OF THE INVENTION

The present invention relates to a caulking tool comprising a planar, substantially T-shaped plate made from aluminum, plated steel or a similar durable yet flexible and bendable material. The T-shaped plate includes a flat elongated portion and a flat caulk applicator tip perpendicular thereto. The elongated portion has one or more retaining bands thereon for encircling a caulking tube nozzle. The applicator tip has a pair of opposing side edges and a longitudinal edge therebetween. Along the longitudinal edge are a plurality of measurement indicia for allowing a user to preselect a caulk joint width. The side edges of the applicator tip are folded to a substantially vertical position so that the fold lines are aligned with the measurement indicia corresponding to the desired width. The folded applicator tip provides a substantially square caulk dispensing opening resulting in a substantially linear, uniform caulk joint that does not require smoothing or wiping. Furthermore, the measurement indicia allow a user to quickly and conveniently apply a bead of caulk having a desired width. It is therefore an object of the present invention to provide a caulking guide which is easy to use and inexpensive to manufacture.

It is yet another object of the present invention to provide a caulking guide which allows a user to preselect a caulk bead width to be applied.

It is yet another object of the present invention to provide a caulking guide that allows a user to apply a caulking bead that is substantially smooth and straight eliminating the burdensome practice of subsequently smoothing the bead with a separate tool. Other objects, features and advantages of the present invention will become readily apparent from the following detailed description of the preferred embodiment when considered with attached drawings and the appended claims.

DESCRIPTION OF THE PREFERRED EMBODIMENT

Figure 1:
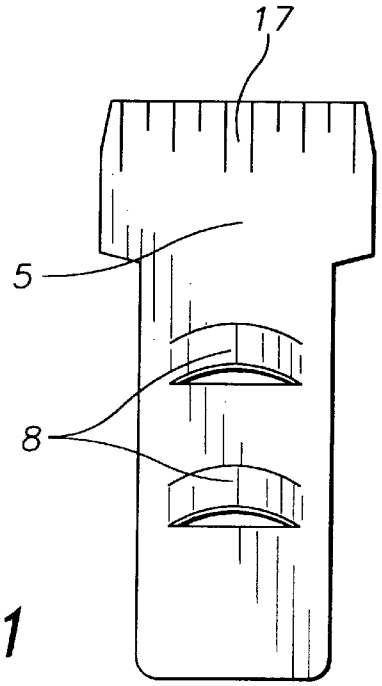
FIG. 1 depicts the inventive device.
Figure 2:
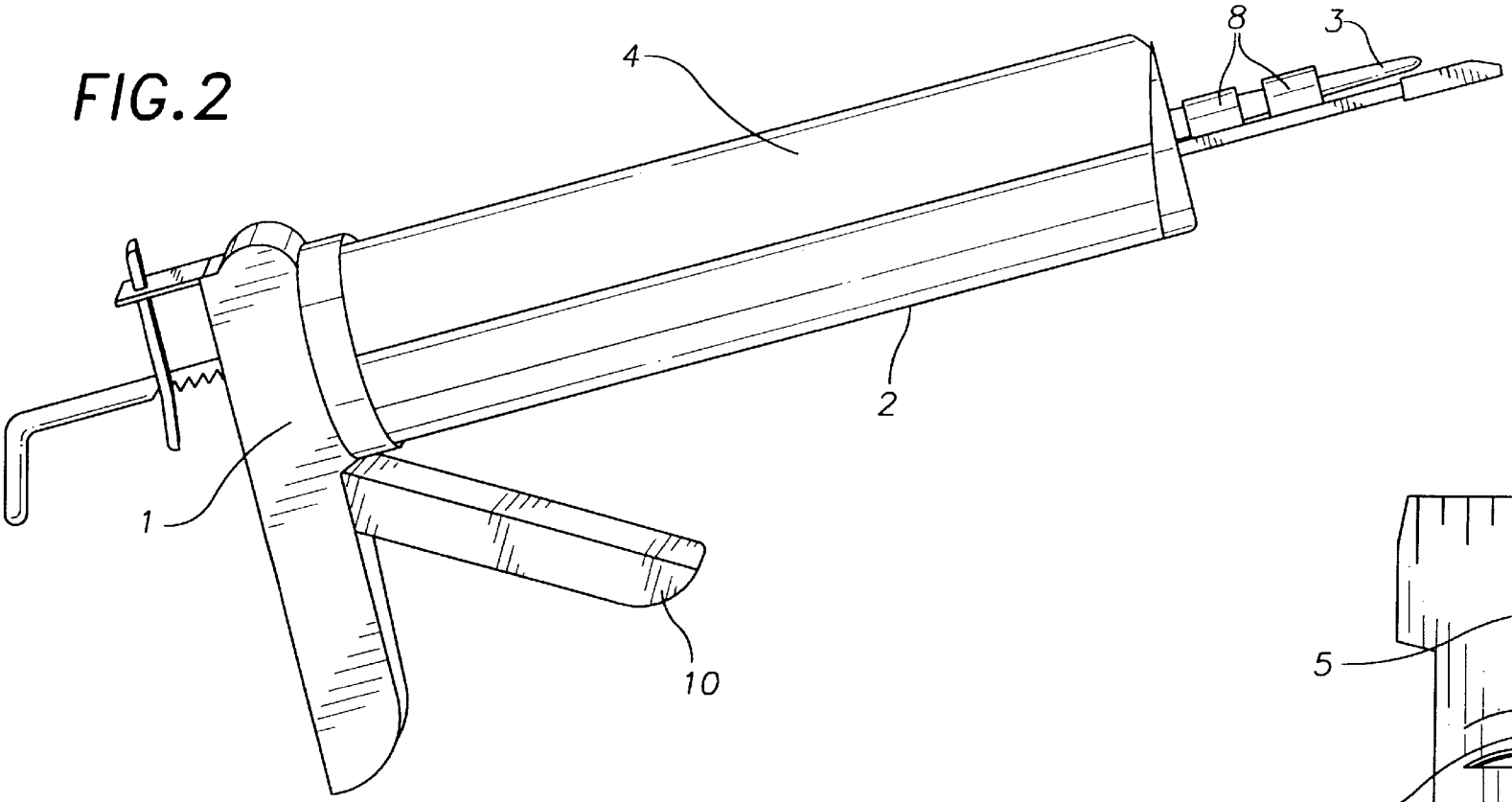
FIG. 2 depicts a tube of caulk received within a caulking gun with the inventive device attached to the caulking tube dispensing nozzle.
Figure 3:
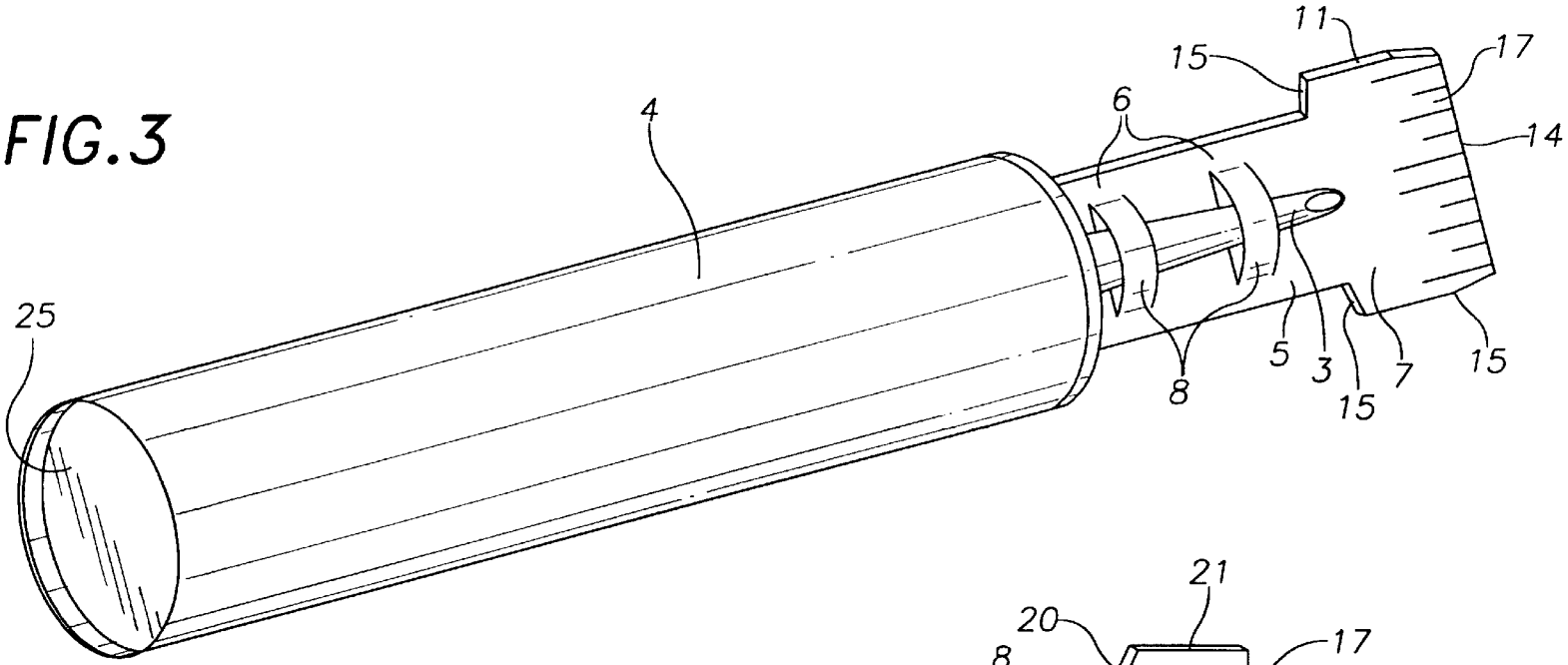
FIG. 3 depicts the inventive device attached to a caulking tube dispensing nozzle.

The present invention relates to a caulking guide used in combination with a caulking gun and tube assembly. Caulk is typically applied with a caulking gun 1 having a semicircular caulking tube holding receptacle 2. At one end of the receptacle is a plate longitudinally translatable relative to the holding receptacle 2 for displacing an end cap 25 of the caulking tube 4. The end cap is displaced by actuating a trigger 10 at which time caulk is dispensed through an elongated dispensing nozzle 3 at an opposing end of the caulking tube 4.

The present invention provides a guide that is attachable to the caulking tube nozzle 3 and comprises a planar, substantially T-shaped plate 5 preferably made from aluminum, plated steel or a similar durable but bendable material. The T-shaped plate 5 includes a flat elongated portion 6 having an upper surface and a planar leg 7 perpendicular thereto and integral with an end thereof which functions as an applicator tip. On the upper surface of the elongated portion 6 are one or more retaining bands 8 for encircling a caulking tube nozzle to secure the plate 5 thereto. In the preferred embodiment, two retaining bands 8 are provided. However, as will be readily apparent to those skilled in the art, any number of bands 8 may be provided without departing from the spirit of the present invention.

The applicator tip has two opposing side edges 11, a longitudinal outer edge 14 therebetween and a pair of opposed inner edges 15 each substantially parallel to said outer edge. Along the longitudinal outer edge 14 of the applicator tip are a plurality of opposed pairs of measurement indicia 17 sequentially increasing from the intermediate portion of the applicator tip to the side edges. The measurement indicia 17 are substantially perpendicular to the outer edge 14. For example, a pair of juxtaposed ⅛ inch marks may be centrally disposed on the applicator tip with a distance of ⅛ inch therebetween. A pair of ¼ inch marks relatively spaced at ¼ inch may be provided with the ⅛ inch marks therebetween and so forth. As will be readily apparent to those skilled in the art, any number or combination of measurement increments may be used including metric unit measurements.

To use the device, the caulking tube nozzle 3 is inserted into the retaining bands 8 with a distal end of the nozzle 3 resting on the upper surface of the applicator tip 7. The user then folds each side edge 11 of the applicator tip 7 at a preselected position depending upon the desired bead size. For instance, for a ¼ inch bead width, the user folds each side edge 11 to form a fold line at each ¼ inch mark. Each side edge is preferably folded to a substantially perpendicular position with respect to the plate. Thus, the caulk will be dispensed through an opening having a substantially square cross sectional configuration thereby depositing a linear, smooth bead 22. Furthermore, the width of the opening may be selectively varied to apply a bead having a selected dimension. Therefore, a user will not have to later smooth or wipe the caulking bead with a putty knife or a similar tool.

Figure 4:
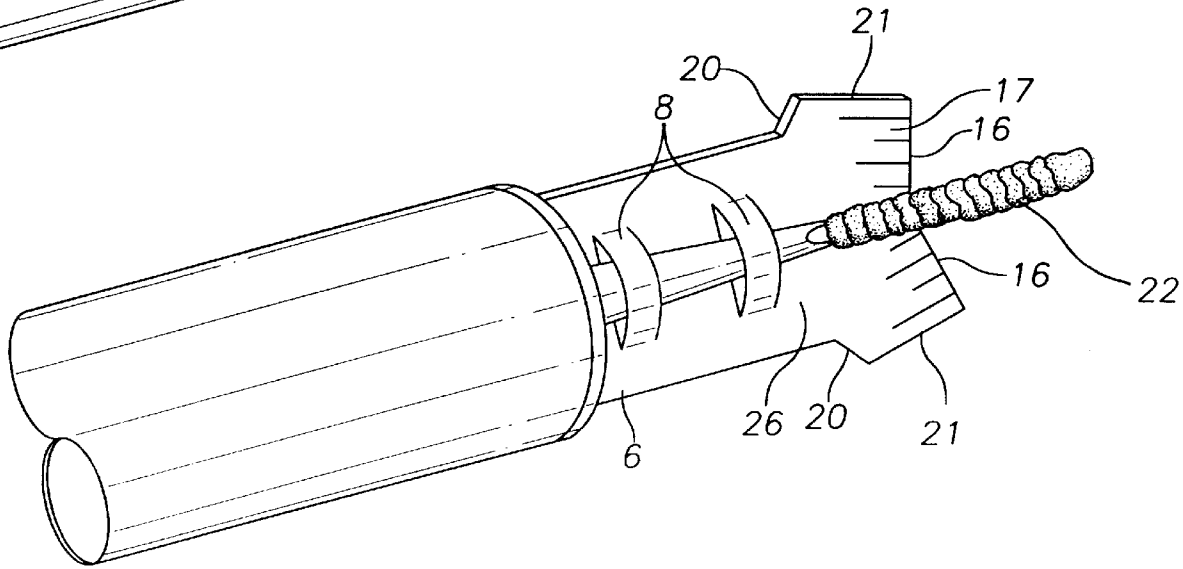
FIG. 4 depicts a second embodiment of the inventive device.

FIG. 4 depicts a second embodiment of the inventive device 26 which may be applied to joints having an angular configuration and other awkward locations. In the second embodiment, the inner edges 20 of the applicator tip extend obliquely from opposing sides of the elongation portion 6. The side edges 21 likewise extend obliquely from the inner edges and converge slightly until they terminate at the longitudinal outer edge. The outer edge is therefore substantially V-shaped with two diverging portions 16 as depicted in FIG. 4. One set of the opposing measurement marks 17 is substantially perpendicular to a diverging portion while the corresponding, matching marks are substantially perpendicular to the other diverging portion. As with the first embodiment, the side edges 21 of the applicator tip are folded with the fold lines aligned with the measurement indicia corresponding to a desired bead width. As such, the vertically folded side edges will converge towards the caulk dispensing opening.

The plate 5 is preferably formed from a metal blank using the metal stamping process. The stamping process can be used to integrally form the retaining bands. The plate 5 may also be coated with Teflon® to provide a smooth surface preventing the caulk from adhering thereto.

As will be readily apparent to those skilled in the art, the size, shape, materials of construction and color of the device may be varied without departing from the spirit of the present invention. The measurement indicia may be disposed in any number of increments or units depending upon the application.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. In combination with a tube of caulk having an elongated dispensing nozzle extending from an end thereof, a caulking guide comprising:

a flat, rigid but bendable plate including an elongated portion having an upper surface and a flat leg perpendicular thereto and integral therewith, said leg defining an applicator tip;

said applicator tip having two opposing side edges and a longitudinal outer edge therebetween;

a plurality of measurement indicia immediately adjacent said outer edge;

a retaining band on the upper surface of the elongated portion for receiving the caulking tube nozzle to secure the plate thereto whereby each side edge is folded to a substantially perpendicular position relative to said applicator tip to form opposing fold lines at measurement indicia corresponding to a desired caulk joint width, the space between said side edges and said applicator tip defining a substantially rectangular caulk dispensing opening.

2. A caulking guide according to claim 1 wherein said retaining bands are integral with said plate.

3. A caulking guide according to claim 1 wherein said plate is coated with Teflon® preventing caulk from adhering thereto.

4. A caulking guide according to claim 1 wherein said measurement indicia are arranged in opposing, matching pairs incrementally disposed from an intermediate portion of the tip outer edge to the side edges.

5. In combination with a caulking tube having an elongated dispensing nozzle extending therefrom, a caulking guide comprising:

a flat, rigid but bendable plate including an elongated portion having an upper surface and an applicator tip integral with an end thereof, said applicator tip having a pair of oblique opposing side edges and a substantially V-shaped longitudinal outer edge;

a plurality of measurement indicia disposed along said V-shaped longitudinal outer edge;

a retaining band on the upper surface of said elongated portion for receiving the caulking tube nozzle to secure the plate thereto.

6. A caulking guide according to claim 5 wherein said retaining band is integral with said plate.

7. A caulking guide according to claim 5 wherein said plate is coated with Teflon.

8. A caulking guide according to claim 5 wherein said measurement indicia are arranged in opposing, matching pairs incrementally disposed from an intermediate portion of the tip outer edge to the side edges.

* * * * *